US010358814B2

(12) United States Patent
Maziarz

(10) Patent No.: US 10,358,814 B2
(45) Date of Patent: Jul. 23, 2019

(54) EXPANSION/CONTROL JOINT FOR STUCCO SURFACES AND RELATED SYSTEMS AND METHODS

(71) Applicant: E-Z BEAD, LLC, Royersford, PA (US)

(72) Inventor: Jeffrey Maziarz, Royersford, PA (US)

(73) Assignee: EZ BEAD, LLC, Royersford, PA (US)

( * ) Notice: Subject to any disclaimer, the term of this patent is extended or adjusted under 35 U.S.C. 154(b) by 0 days.

(21) Appl. No.: 15/865,952

(22) Filed: Jan. 9, 2018

(65) Prior Publication Data

US 2018/0195272 A1 Jul. 12, 2018

Related U.S. Application Data

(60) Provisional application No. 62/444,670, filed on Jan. 10, 2017.

(51) Int. Cl.

| | |
|---|---|
| ***E04F 13/04*** | (2006.01) |
| ***E04F 13/06*** | (2006.01) |
| ***E04C 3/02*** | (2006.01) |
| ***E04B 1/68*** | (2006.01) |

(52) U.S. Cl.

CPC ..... *E04B 1/6815* (2013.01); *E04B 1/6809* (2013.01); *E04B 1/6813* (2013.01); *E04F 13/06* (2013.01); *E04F 13/045* (2013.01); *E04F 13/068* (2013.01); *E04F 2013/066* (2013.01)

(58) Field of Classification Search

CPC ..... E04F 1/6815; E04F 13/06; E04F 13/045; E04F 13/068; E04F 13/04; E04B 1/6815; E04B 1/6809; E04B 1/6813; E04B 1/68; E04B 1/6807; E06B 1/62; E06B 7/2303; E04C 3/02

See application file for complete search history.

(56) References Cited

U.S. PATENT DOCUMENTS

| | | | |
|---|---|---|---|
| 517,701 | A | 4/1894 | Knower |
| 1,030,044 | A | 6/1912 | Whittbecker |
| 1,361,843 | A | 12/1920 | Flagge |
| 1,386,509 | A | 8/1921 | Kirmes |
| 1,673,971 | A | 6/1928 | Dowell |
| 1,679,914 | A | 8/1928 | Murray |
| 1,840,221 | A | 1/1932 | Bridges |
| 1,886,320 | A | 11/1932 | Waite |
| 1,956,809 | A | 5/1934 | Robertson |
| 2,031,249 | A | 2/1936 | Bowman |
| 2,151,605 | A | 3/1939 | Lavering |
| 2,189,216 | A | 2/1940 | Mathias |

(Continued)

FOREIGN PATENT DOCUMENTS

| | | | |
|---|---|---|---|
| DE | 2455775 | 8/1976 | ..... E04F 15/14 |
| DE | 2538412 | 3/1977 | ..... E04F 15/14 |

(Continued)

OTHER PUBLICATIONS

U.S. Appl. No. 15/410,494, filed Jan. 19, 2017, Maziarz.

(Continued)

*Primary Examiner* — Phi D A

(74) *Attorney, Agent, or Firm* — Hayes Soloway P.C.

(57) ABSTRACT

An expansion/control joint for use within a stucco or plaster wall includes a first base panel having a first stucco stop wall formed on the first base panel and extending from the first base panel. A second base panel has a second stucco stop wall formed on the second base panel and extends from the second base panel. The second stucco stop wall is positioned spaced a distance from the first stucco stop wall. A single expansion joint is connected between the first and second stucco stop walls and extends the spaced distance between the first and second stucco stop walls.

18 Claims, 11 Drawing Sheets

(56) References Cited

U.S. PATENT DOCUMENTS 2,198,084 A 4/1940 Jacobson
2,272,162 A 2/1942 Lackey
2,286,890 A 6/1942 Birt
2,405,844 A 8/1946 Mortenson
2,725,608 A 12/1955 Parslow
2,732,045 A 1/1956 Herlocker
2,742,120 A 4/1956 Rosebrook
2,845,666 A 8/1958 Knapp
RE24,658 E 6/1959 Hollister
2,904,992 A 9/1959 Cruser
2,953,835 A 9/1960 Armstrong
3,192,577 A 7/1965 Barr
3,201,908 A 8/1965 Arnold
3,213,577 A 10/1965 Levin
3,319,384 A 5/1967 Berg
3,320,707 A * 5/1967 Berg ..... E04D 3/366 52/395
3,344,720 A * 10/1967 Hallock ..... E01D 19/06 14/73.1
3,349,519 A 10/1967 Nehlig
3,398,494 A 8/1968 Larson
3,421,267 A * 1/1969 Reiff ..... E04D 13/1415 52/199
3,425,172 A * 2/1969 Attaway ..... E04D 13/1415 52/395
3,486,283 A 12/1969 Arnett
3,512,318 A 5/1970 Turner
3,608,254 A 9/1971 Sklamberg
3,619,944 A 11/1971 Matvey
3,667,174 A * 6/1972 Arnett ..... E04B 1/6807 52/100
3,670,470 A * 6/1972 Thom ..... E04D 13/151 52/395
3,765,138 A 10/1973 Bentle
3,782,680 A 1/1974 Hopkins
3,813,180 A 5/1974 O'Brill
3,849,958 A * 11/1974 Balzer ..... E04B 1/6804 52/396.05
3,871,787 A 3/1975 Stegmeier
3,922,826 A 12/1975 Molyneux
3,964,220 A 6/1976 Rutkowski
3,974,609 A * 8/1976 Attaway ..... E04B 1/6804 52/273
4,038,791 A 8/1977 Atkinson
4,111,583 A * 9/1978 Brady ..... E01D 19/06 14/73.1
4,271,650 A * 6/1981 Lynn-Jones ..... E04B 1/6804 404/69
4,295,315 A * 10/1981 Lynn-Jones ..... E04B 1/6804 14/73.1
4,359,847 A * 11/1982 Schukolinski ..... E04B 1/6804 404/68
4,505,079 A 3/1985 Black
4,545,162 A 10/1985 Attaway
4,651,488 A 3/1987 Nicholas
4,663,883 A 5/1987 Hilliard
4,726,148 A 2/1988 Tix
4,763,455 A 8/1988 Schneller
4,774,795 A 10/1988 Braun
4,781,004 A 11/1988 Hartman
4,784,516 A 11/1988 Cox
4,785,601 A 11/1988 Tupman
4,829,731 A 5/1989 Schluter
4,833,851 A * 5/1989 Ohmatsu ..... E04B 1/6804 404/52
4,841,704 A 6/1989 Jarrell
5,014,471 A 5/1991 Ballstadt
5,042,211 A 8/1991 Nestler
5,073,430 A 12/1991 Aidan
5,127,204 A 7/1992 Braun
5,181,357 A 1/1993 Pourtau
5,210,986 A 5/1993 Hagemeyer
5,222,343 A 6/1993 Anderson
5,230,738 A 7/1993 Wheeler
5,305,566 A 4/1994 Larkowski
5,313,755 A 5/1994 Koenig, Jr.
5,333,432 A 8/1994 Schluter
5,338,130 A 8/1994 Baerveldt
5,365,713 A * 11/1994 Nicholas ..... E04B 1/681 52/396.03
5,384,996 A * 1/1995 Nicholas ..... E04B 1/681 404/57
5,423,154 A 6/1995 Maylon
5,430,981 A 7/1995 Scott
5,450,699 A 9/1995 Lee
D364,233 S 11/1995 Caley
5,544,445 A 8/1996 Mantilla
5,551,201 A 9/1996 Anderson
5,560,166 A * 10/1996 Burke ..... F16J 15/065 52/218
5,575,126 A * 11/1996 Attaway ..... E04B 1/6804 404/48
5,579,623 A 12/1996 Stark
5,607,253 A 3/1997 Almstrom
5,671,571 A 9/1997 Braun
5,699,638 A 12/1997 Maylon
5,761,866 A 6/1998 Maylon
5,790,671 A 8/1998 Cooper
5,791,111 A * 8/1998 Beenders ..... E04B 1/6804 404/67
5,791,116 A 8/1998 Skintzis
5,950,370 A 9/1999 Peck
5,970,671 A 10/1999 Bifano et al.
6,018,924 A 2/2000 Tamlyn
6,102,407 A 8/2000 Moriya et al.
6,119,416 A 9/2000 Larson
6,122,883 A 9/2000 Braun
6,131,352 A * 10/2000 Barnes ..... E04B 1/948 52/396.01
6,223,486 B1 5/2001 Dunham
6,298,609 B1 10/2001 Bifano
6,308,475 B1 10/2001 Crish, II
6,322,045 B1 11/2001 Andros
6,338,229 B1 1/2002 Botzen
D456,528 S 4/2002 Maylon
6,367,210 B1 4/2002 Trundle
6,425,216 B1 7/2002 Gardner
6,490,831 B1 12/2002 Candusso
D471,991 S 3/2003 Maylon
6,527,467 B2 * 3/2003 Betts ..... E01D 19/065 403/122
6,631,595 B1 10/2003 Minter
6,705,047 B2 3/2004 Yulkowski
7,406,805 B1 8/2008 Larson
7,458,190 B2 12/2008 Isaac et al.
7,526,897 B2 5/2009 Collins
7,634,883 B1 12/2009 Larson
7,874,123 B2 1/2011 Maziarz
8,132,380 B2 3/2012 Wilkes, Jr.
8,615,944 B2 12/2013 Maziarz
8,646,235 B2 * 2/2014 Hilburn, Jr. ..... E04B 1/948 52/232
9,062,453 B1 * 6/2015 Maziarz ..... E04B 1/68
2002/0124504 A1 9/2002 Maylon
2003/0051422 A1 3/2003 Maziarz
2004/0020143 A1 2/2004 Webb
2006/0150553 A1 * 7/2006 Reyes ..... E04F 13/06 52/393

FOREIGN PATENT DOCUMENTS

DE 3503395 8/1986 ..... E04B 1/68
FR 2307091 11/1976
FR 2412236 7/1979
FR 2507227 12/1982 ..... E04B 1/68
SU 1705521 1/1992

OTHER PUBLICATIONS

U.S. Appl. No. 15/791,246, filed Oct. 23, 2017, Maziarz.

(56) References Cited

OTHER PUBLICATIONS

Notice of Allowance issued in U.S. Appl. No. 11/981,421, dated Sep. 8, 2010 (6 pgs).
Notice of Allowance issued in U.S. Appl. No. 12/152,046, dated Feb. 12, 2014 (16 pgs).
Notice of Allowance issued in U.S. Appl. No. 12/931,079, dated Aug. 21, 2013 (11 pgs).
Notice of Allowance issued in U.S. Appl. No. 14/275,757, dated Jan. 29, 2016 (5 pgs).
Office Action issued in U.S. Appl. No. 09/952,920, dated Jan. 22, 2003 (12 pgs).
Office Action issued in U.S. Appl. No. 09/952,920, dated Jan. 26, 2005 (9 pgs).
Office Action issued in U.S. Appl. No. 09/952,920, dated Jun. 22, 2004 (6 pgs).
Office Action issued in U.S. Appl. No. 09/952,920, dated Oct. 22, 2003 (7 pgs).
Office Action issued in U.S. Appl. No. 11/259,499, dated Aug. 28, 2008 (9 pgs).
Office Action issued in U.S. Appl. No. 11/259,499, dated Oct. 23, 2007 (6 pgs).
Office Action issued in U.S. Appl. No. 11/259,499, dated Sep. 7, 2006 (9 pgs).
Office Action issued in U.S. Appl. No. 11/981,421, dated Aug. 5, 2009 (6 pgs).
Office Action issued in U.S. Appl. No. 12/152,046, dated Feb. 28, 2011 (7 pgs).
Office Action issued in U.S. Appl. No. 12/152,046, dated Nov. 30, 2011 (6 pgs).
Office Action issued in U.S. Appl. No. 12/152,046, dated Nov. 2, 2012 (28 pgs).
Office Action issued in U.S. Appl. No. 12/931,079, dated Oct. 15, 2012 (29 pgs).
Office Action issued in U.S. Appl. No. 12/931,079, dated Sep. 23, 2011 (11 pgs).
Office Action issued in U.S. Appl. No. 14/275,721, dated Jul. 13, 2015 (8 pgs).
Office Action issued in U.S. Appl. No. 14/275,721, dated Sep. 29, 2014 (9 pgs).
Office Action issued in U.S. Appl. No. 14/275,757, dated Jul. 14, 2015 (8 pgs).
Office Action issued in U.S. Appl. No. 14/275,757, dated Sep. 29, 2014 (9 pgs).
Office Action issued in U.S. Appl. No. 15/062,876, dated Oct. 19, 2016 (17 pgs).

* cited by examiner

EXPANSION/CONTROL JOINT FOR STUCCO SURFACES AND RELATED SYSTEMS AND METHODS

CROSS REFERENCE TO RELATED APPLICATION

This application claims benefit of U.S. Provisional Application Ser. No. 62/444,670 entitled, "Expansion/Control Joint for Stucco Surfaces" filed Jan. 10, 2017, the entire disclosure of which is incorporated herein by reference.

FIELD OF THE DISCLOSURE

This invention relates to the application of stucco or plaster in homes or other buildings and specifically to an expansion/control joint used to relieve stress and limit or control cracking in a stucco or plaster wall or surface caused by stucco or plaster shrinkage and thermal movement in the stucco or plaster wall or surface.

BACKGROUND OF THE DISCLOSURE

Stucco and/or plaster are typically used for both interior and exterior surfaces in home or commercial building construction. Stucco or plaster is routinely applied to a galvanized wire mesh over felt paper which has been attached to underlying plywood or other sheathing material. In order to relieve stress and limit or control cracking in a stucco or a plaster surface, expansion/control joints are typically provided in the stucco or plaster surface every 144 square feet of stucco or plaster surface.

A makeshift expansion/control joint is often used for this purpose. The makeshift expansion/control joint comprises two plaster stops, e.g., a first plaster stop and a second plaster stop, which are positioned adjacent to each other and face opposite directions from each other. Each of the plaster stops generally comprise a perforated plastic strip approximately 2 inches wide with a plaster lip or edge acting to contain the stucco or plaster. The first plaster stop is typically installed approximately ¼ inch away from the second plaster stop with the back of the plaster lip of the first plaster stop facing the back of the plaster lip of the second plaster stop, leaving a gap between the hack of the plaster lip of the first plaster stop and the back of the plaster lip of the second plaster stop. In order to provide a complete finish, a worker must install a backer rod into the gap and then apply a finishing layer of caulk in the gap and over the backer rod. This process, which is used by some builders to prevent leaks, is very time consuming.

This method of stucco installation has often resulted in leaking problems between adjacent stucco or plaster surfaces, thereby causing significant additional repair costs and frustration to both home owners and construction companies. In addition, the extra time and materials necessary for installation of the backer rod and finishing caulk layer can add considerably to the costs and duration of the construction.

Thus, a heretofore unaddressed need exists in the industry to address the aforementioned deficiencies and inadequacies.

SUMMARY OF THE DISCLOSURE

Embodiments of the present disclosure provide an expansion/control joint for use within at least one of a stucco and plaster wall. Briefly described, in architecture, one embodiment of the system, among others, can be implemented as follows. The expansion/control joint for use within at least one of a stucco and plaster wall has a first base panel having a first stucco stop wall formed on the first base panel and extending from the first base panel. A second base panel has a second stucco stop wall formed on the second base panel and extends from the second base panel. The second stucco stop wall is positioned spaced a distance from the first stucco stop wall. A single expansion joint is connected between the first and second stucco stop walls and extends the spaced distance between the first and second stucco stop walls.

The present disclosure can also be viewed as providing an expansion/control joint for use within at least one of a stucco and plaster wall. Briefly described, in architecture, one embodiment of the joint, among others, can be implemented as follows. The expansion/control joint for use within at least one of a stucco and plaster wall has first base panel having a first stucco stop wall formed on the first base panel and extending from the first base panel. A second base panel has a second stucco stop wall formed on the second base panel and extends from the second base panel. The second stucco stop wall is positioned spaced a distance from the first stucco stop wall. The first and second base panels are affixed to a backing within the wall, wherein the first and second stucco stop walls extend outwardly from the wall, and wherein at least one layer of at least one of stucco and plaster is positioned over the first and second base panels. A single expansion joint is connected between the first and second stucco stop walls and extends the spaced distance between the first and second stucco stop walls. A bond breaking tape and quantity of caulk are positioned within the spaced distance exterior of the single expansion joint, wherein an exterior surface of the quantity of caulk is positioned in substantial alignment with an exterior surface of the at least one layer of at least one of stucco and plaster positioned over the first and second base panels.

The present disclosure can also be viewed as providing an expansion/control joint used to separate stucco or plaster material during application of the stucco or plaster material to a wall into sub-portions, and to relieve stress and limit or control cracking in a stucco or plaster wall or surface caused by stucco or plaster shrinkage and thermal movement in the stucco or plaster wall or surface. Briefly described, in architecture, one embodiment of the joint, among others, can be implemented as follows. An expansion/control joint is used to separate stucco or plaster material during application of the stucco or plaster material to a wall into sub-portions, and to relieve stress and limit or control cracking in a stucco or plaster wall or surface caused by stucco or plaster shrinkage and thermal movement in the stucco or plaster wall or surface. The expansion/control joint has: a first base panel having a front face, a first stucco stop wall formed on the first base panel and extending outwardly above the front face of the first base panel, the first stucco stop wall having a first side and a second side, the first side of the first stucco stop wall having an engaging surface for engaging plaster or stucco material, a second base panel having a front face, a second stucco stop wall formed on the second base panel and extending outwardly above the front face of the second base panel, the second stucco stop wall having a first side and a second side, the first side of the second stucco stop wall having an engaging surface for engaging plaster or stucco material, a single expansion/contraction member extending between the second side of the first stucco stop wall of the first base panel and the second side of the second stucco stop wall of the second base panel for relieving stress and controlling cracks in stucco or plaster surfaces, the expansion/contraction member being flexible to permit movement of the expansion/contraction member responsive to weather induced movement of the stucco or plaster material, the expansion/contraction member comprising a single flexible panel extending between the second sides of the first and second stucco stop walls, the single flexible panel forming in conjunction with the second sides of the first and second stucco stop walls a flexible slot extending along and between the second sides of the first and second stucco stop walls which flexes to accommodate expansion and contraction of the stucco or plaster material, a caulk receiving area formed between the second sides of the first and second stucco stop walls and above the upper panel of the expansion/contraction member for receiving caulk, the upper panel of the expansion/contraction member having an upper end portion having an outer surface, and bond-breaking tape mounted on the outer surface of the upper end portion of the upper panel of the expansion/contraction member the first stucco stop wall having an upper end portion and a flange formed in its upper end portion to assist in containing stucco or plaster material, the flange extending laterally away from the first stucco stop wall and over the first base panel, and the flange of the first stucco stop wall having an upper outer surface, the second stucco stop wall having an upper end portion and a flange formed in its upper end portion to assist in containing stucco or plaster material, the flange extending laterally away from the second stucco stop wall and over the second base panel, and the flange of the second stucco stop wall having an upper outer surface, and further including a strip of removable tape applied to the upper outer surface of the flange of the first stucco stop wall and to the upper outer surface of the flange of the second stucco stop wall and extending over the channel between the first and second stucco stop walls such that the removable tape covers the channel between the first and second stucco stop walls to prevent dirt, stucco, plaster, and the like from entering the channel during installation of the stucco or plaster material.

Other systems, methods, features, and advantages of the present disclosure will be or become apparent to one with skill in the art upon examination of the following drawings and detailed description. It is intended that all such additional systems, methods, features, and advantages be included within this description, be within the scope of the present disclosure, and be protected by the accompanying claims.

BRIEF DESCRIPTION OF THE DRAWINGS

Many aspects of the disclosure can be better understood with reference to the following drawings. The components in the drawings are not necessarily to scale, emphasis instead being placed upon clearly illustrating the principles of the present disclosure. Moreover, in the drawings, like reference numerals designate corresponding parts throughout the several views.

DETAILED DESCRIPTION

Figure 1:
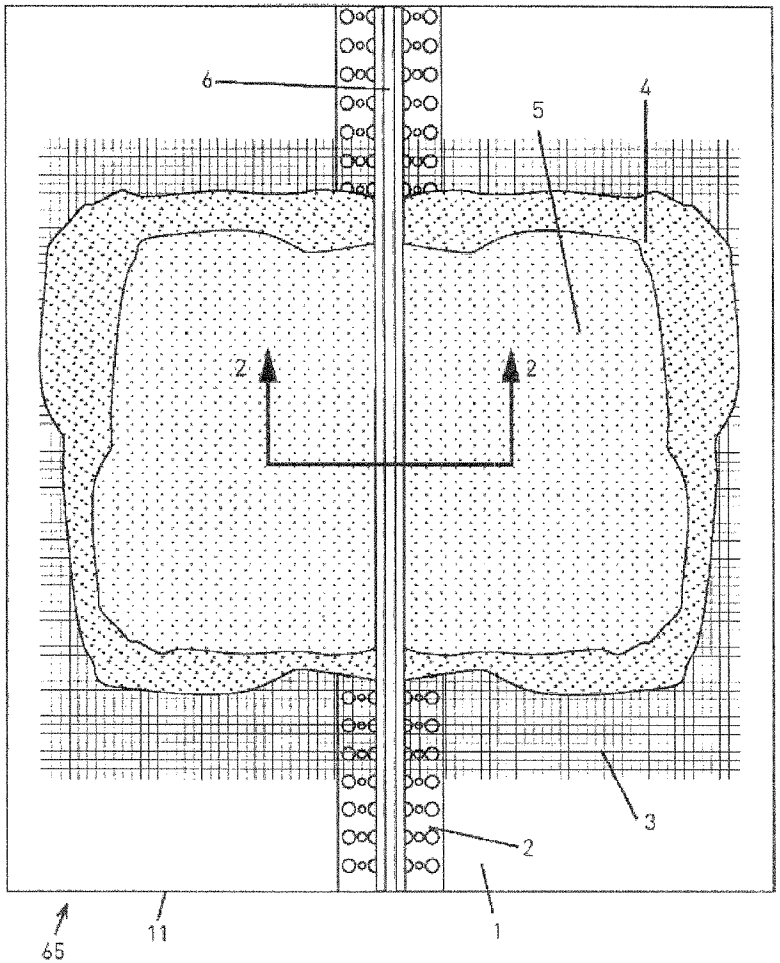
FIG. 1 is a diagrammatical illustration of a stucco or plaster wall construction with an expansion/control joint, in accordance with a first exemplary embodiment of the present disclosure.

To improve upon the conventional makeshift control/expansion joints, various improvements have been proposed. FIG. 1 is a diagrammatical illustration of a stucco or plaster wall construction with an expansion/control joint, in accordance with a first exemplary embodiment of the present disclosure. As shown, instead of using an expansion/control joint that comprises two plaster stops mounted adjacent to each about ¼ inch apart forming a gap therebetween, with the gap being filled with a backer rod and a finishing layer of caulk, as has been done conventionally, a novel expansion/control joint 2 constructed is used. A wire mesh layer 3 of galvanized wire is anchored over felt paper 1 to a hacking wall 11, which commonly is constructed from plywood, particle board, oriented strand board (OSB), or a similar material. Scratch coats 4 of plaster or stucco and finish coats 5 of plaster or stucco are applied to the wire layer 3. To relieve stress and limit or control cracking in the stucco or plaster wall or surface, an expansion/control joint 2 may be positioned in the stucco or plaster wall or surface every 144 square feet of the stucco or plaster wall or surface. The expansion/control joints 2 are nailed to the backing wall or surface 11 over, behind, or adjacent to the galvanized wire layer 3 where it is desired to position the expansion/control joint 2, typically at locations in the stucco or plaster wall or surface such that the sub-portions of the stucco or plaster wall or surface formed by the expansion/control joints dividing the wall or surface into sub-portions have an area of 144 square feet or less. No backing rod is necessary. A final small thin layer 6 of caulk is applied to finish the job.

Figure 2:
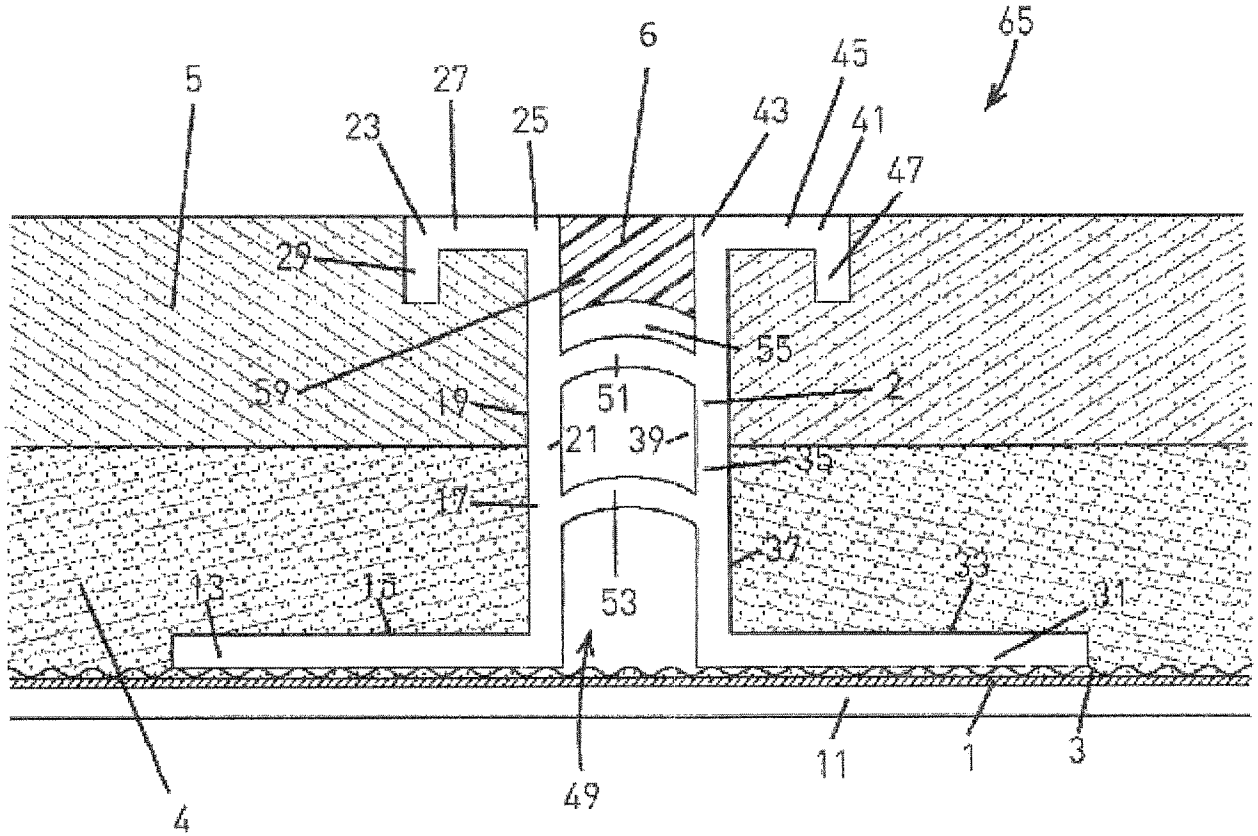
FIG. 2 is diagrammatical, cross-sectional view illustration taken along the lines and arrows 2-2 of FIG. 1, in accordance with the first exemplary embodiment of the present disclosure.

FIG. 2 is a diagrammatical, cross-sectional view illustration taken along the lines and arrows 2-2 of FIG. 1, in accordance with the first exemplary embodiment of the present disclosure. As shown, the expansion/control joint 2 includes a first base panel 13 having a front face 15 over which plaster or stucco material, such as a scratch coat 4 and a finish coat 5, is applied after the expansion/control joint 2 is mounted in place on the backing wall or surface 11. A stucco stop wall 17 is formed on the first base panel 13 and extends outwardly above the front face 15 of the first base panel 13, and the stucco stop wall 17 has a first side 19 and a second side 21. The first side 19 of the stucco stop wall 17 has an engaging surface for engaging plaster or stucco material. Preferably the stucco stop wall 17 has a flange or return 23 formed on its upper end portion 25 to assist in containing plaster or stucco, with the flange 23 having a first portion 27 that extends laterally away from the stucco stop wall 17 and over the first base panel 13 and a second portion 29 extending from the first portion 27 downwardly toward the first base panel 13.

The expansion/control joint 2 also includes a second base panel 31 having a front face 33 over which plaster or stucco material 4,5 is applied after the expansion/control joint 2 is mounted in place on the hacking wall or surface 11. A stucco stop wall 35 is formed on the second base panel 31 and extends outwardly above the front face 33 of the second base panel 31, and the stucco stop wall 35 has a first side 37 and a second side 39. The first side 37 of the stucco stop wall 35 has an engaging surface for engaging plaster or stucco material. Preferably, the stucco stop wall 35 has a flange or return 41 formed on its upper end portion 43 to assist in containing plaster or stucco, with the flange 41 having a first portion 45 that extends laterally away from the stucco stop wall 35 and over the second base panel 31 and a second portion 47 extending from the first portion 45 downwardly toward the second base panel 31.

The expansion/control joint 2 also includes an expansion/contraction portion 49 extending between the second side 21 of the stucco stop wall 17 of the first base panel 13 and the second side 39 of the stucco stop wall 35 of the second base panel 31 for relieving stress and limiting or controlling cracking in stucco or plaster walls or surfaces. In the first exemplary embodiment, the expansion/contraction portion 49 comprises two panels 51 and 53 extending between the second sides 21 and 39 of the stucco stop walls 17 and 35 forming a hollow tube extending along and between the stucco stop walls 17 and 35, and preferably, the each panel 51 and 53 bows slightly upwardly such that force placed thereon due to expansion of the stucco or plaster wall or surface facilitates flexing of the panels 51 and 53 to permit the two stucco stop walls 17 and 35 to move closer to each other in response to expansion forces placed on the expansion/control joint 2 by the stucco or plaster walls or surfaces in contact with the expansion/control joint 2, and such that force placed thereon due to contraction of the stucco or plaster wall or surface tends to straighten the panels 51 and 53 to permit the two stucco stop walls 17 and 35 to move away from each other in response to contraction forces placed on the expansion/control joint 2 by the stucco or plaster walls or surfaces in contact with the expansion/control joint 2.

The expansion/contraction portion 49 may be comprised of a flexible, preferably resilient, material, such as a plastic or a polymer such as flexible vinyl, which is preferably a flexible exterior grade vinyl, metal, or similar material, which may be formed by co-extruding the expansion/contraction portion 49 with the remainder of the expansion/control joint 2. Accordingly, the expansion/control joint 2 may be formed from a material that is compatible for co-extrusion with the material that is used for the base panels 13 and 31 and the stucco stop walls 17 and 35, such as a rigid exterior grade vinyl which is compatible with a flexible exterior grade vinyl if a flexible exterior grade vinyl is used for the expansion/contraction portion 49, or a rigid metal with a flexible metal compatible to the rigid metal if a flexible metal is used for the expansion/contraction portion 49. Also, the expansion/control joint 2 preferably is extruded as one piece.

Also, preferably, a strip of bond-breaking tape 55 is affixed to the upper surface of the upper panel 51, to hinder caulk 6 that is applied in the channel 59 between the two second sides 21 and 39 of the stucco stop walls 17 and 35 from bonding to the upper surface of the upper panel 51, such that the caulk 6 adheres only to the two opposing second sides 21 and 39 of the two stucco stop walls 17 and 35 and not to the upper panel 51. The bond-breaking tape 55 hinders formation of a bond between the caulk 6 and the bond-breaking tape 55.

Figure 3:
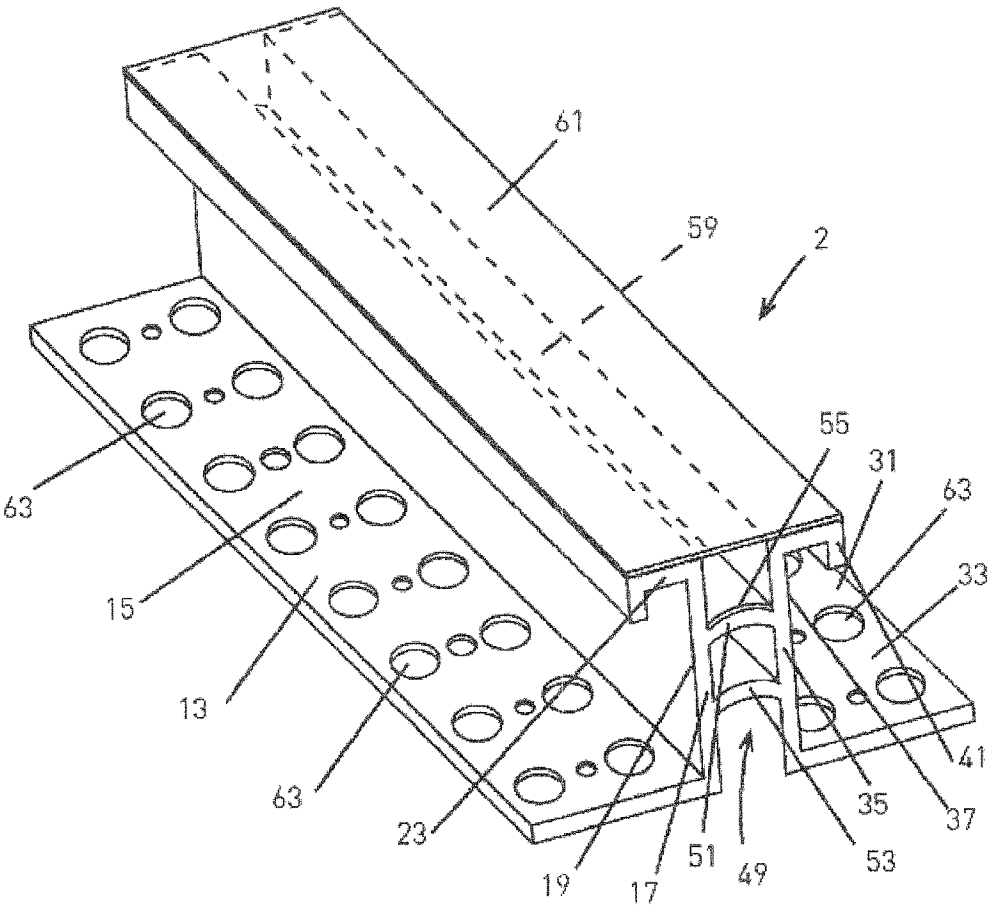
FIG. 3 is perspective view illustration of the expansion/control joint prior to being installed onto the stucco or plaster wall or surface, in accordance with the first exemplary embodiment of the present disclosure.
Figure 4:
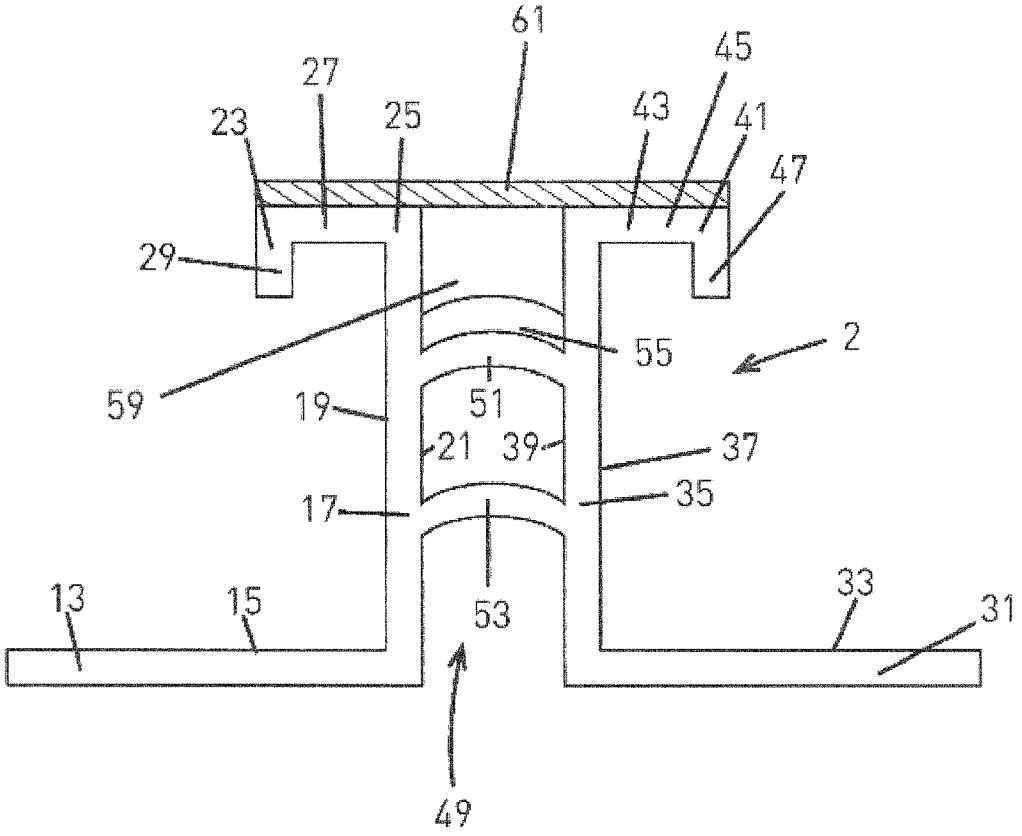
FIG. 4 is side-view illustration of the expansion/control joint prior to being installed onto the stucco or plaster wall or surface, in accordance with the first exemplary embodiment of the present disclosure.

FIG. 3 is a perspective view illustration of the expansion/control joint 2 prior to being installed onto the stucco or plaster wall or surface, in accordance with the first exemplary embodiment of the present disclosure. FIG. 4 is a side-view illustration of the expansion/control joint 2 prior to being installed onto the stucco or plaster wall or surface, in accordance with the first exemplary embodiment of the present disclosure. In some situations, a strip of removable tape 61 is applied to the upper end portions 25 and 43 of the stucco stop walls 17 and 35 such that the removable tape covers the channel 59 between the two stucco stop walls 17 and 35 to prevent dirt, and stucco or plaster, and the like from entering the channel 59 during installation of the stucco or plaster. After installation of the stucco or plaster, the tape 61 may be peeled from the upper end portions 25 and 43 of the stucco stop walls 17 and 35 to permit caulk 6 (typically a simple and thin layer of caulk 6) to be placed within the channel 59 to complete installation. With the bond-breaking tape 55 in place on the upper surface of the upper panel 51, the caulk 6 positioned within the channel 59 (not shown in FIG. 3, but shown in FIG. 4) to complete installation of the expansion/control joint 2 on a stucco or plaster wall or surface bonds only with the adjacent second sides 21 and 39 of the stucco stop walls 17 and 35, thereby creating a double-sided joint (e.g., caulk 6 connected only to the adjacent sides 21 and 39 of the stucco stop walls 17 and 35), rather than a triple-sided joint (e.g., caulk 6 connected to the adjacent sides 21 and 39 of the stucco stop walls 17 and 35 and to the upper surface of the upper panel 51). Also, preferably, each first and second base panel 13 and 31 is provided with perforations 63.

While the expansion/control joint 2 may have various sizes, in one example it may be about 4 inches wide and about ¾ inches high (at the top of the stucco stop walls 17 and 35), and the width of the expansion/contraction portion 49 preferably is ¼ inch to ½ inch and more preferably ⅜ inch. Also, the distance from the top of the expansion/contraction portion 49 to the top of the stucco stop walls 17 and 35 preferably is ¼ inch.

It is noted that the base panels 13 and 31, which preferably have perforations 63 formed therein, are nailed or otherwise attached to the backing wall 11. The two higher lip parts of the joint 2 contain the stucco or plaster. The expansion portion 49 of the expansion/control joint 2 eliminates the need for a hacker rod, thereby cutting down on both leaks and installation time. During an extrusion process for manufacturing of the expansion/control joint 2, preferably the bond-breaking tape 55 and the removable strip of tape 61 are applied to the expansion/control joint 2 as the expansion/control joint 2 exits the extruder.

In use, the expansion/control joint 2 is mounted to a backing wall or surface 11 over, behind, or adjacent to a wire mesh layer 3 of galvanized wire which is anchored to the backing wall or surface 11 over felt paper 1. Plaster or stucco material 4, 5 is applied to the wall or surface 11 and kept separate into sub-portions typically having an area of 144 square feet or less by one or more expansion/control joints 2. Caulk 6 is applied in the channel 59 of the expansion/control joint 2 to seal between adjacent second sides 21 and 39 of the stucco stop walls 17 and 35 of the expansion/control joint 2 and to provide a neat finish.

Because the expansion/contraction portion 49 of the expansion/control joint 2 is flexible and preferably resilient, it permits the stucco or plaster wall or surface 65 to expand and contract, thereby relieving stress and limiting or controlling cracking in the stucco or plaster wall or surface 65 caused by stucco or plaster shrinkage and thermal movement in the stucco or plaster wall or surface 65.

Figure 5A:
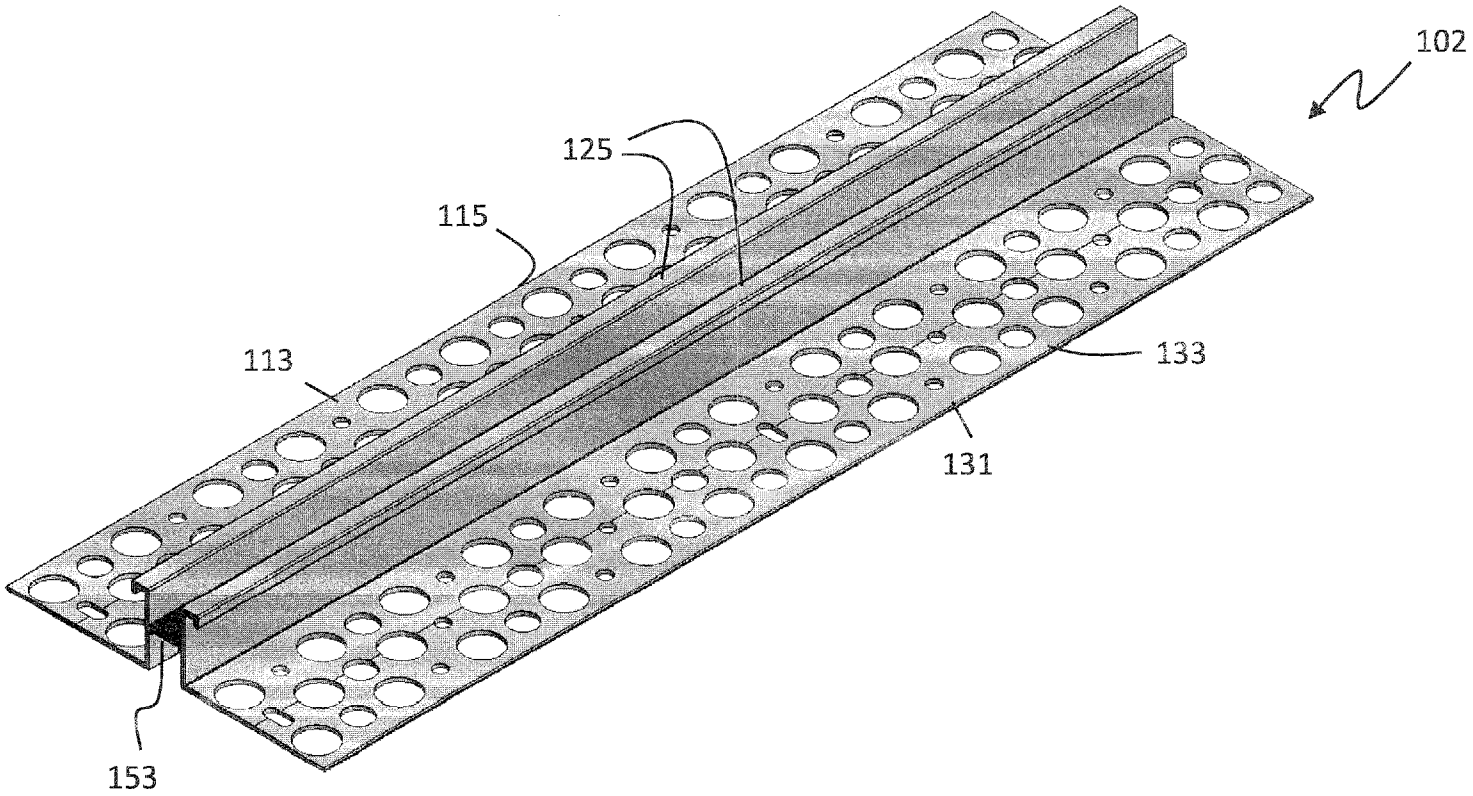
FIG. 5A is an isometric view illustration of an expansion/control joint, in accordance with a second exemplary embodiment of the present disclosure.
Figure 5B:
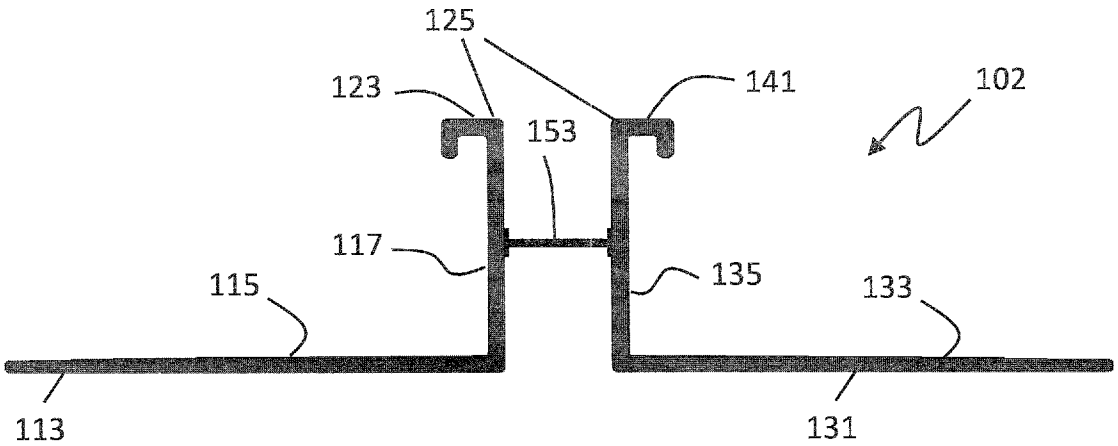
FIG. 5B is a side view illustration of an expansion/control joint, in accordance with the second exemplary embodiment of the present disclosure.
Figure 5C:
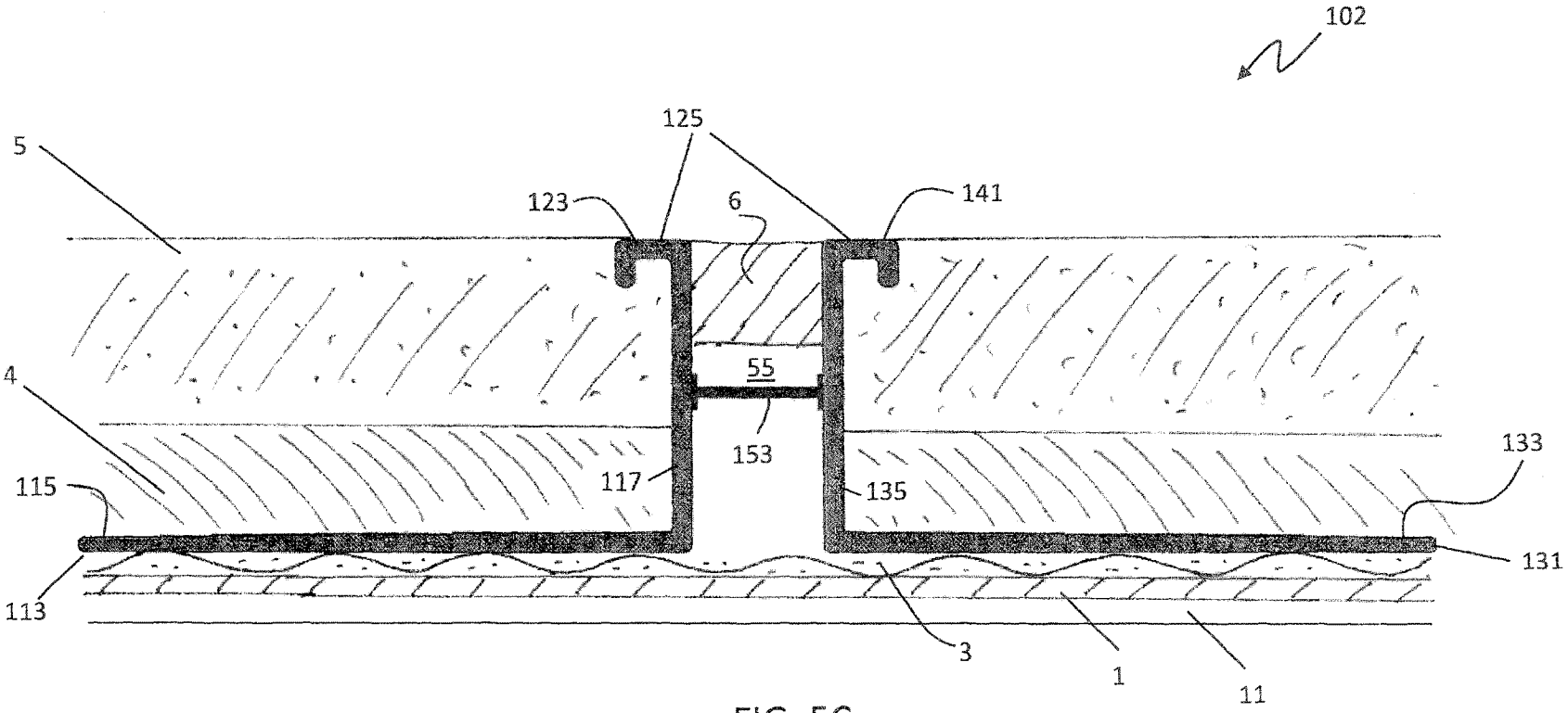
FIG. 5C is a cross-sectional view illustration of the expansion/control joint of FIG. 5B in use within a stucco or plaster wall, in accordance with the second exemplary embodiment of the present disclosure.

FIGS. 5A-5B are isometric and side view illustrations, respectively, of an expansion/control joint 102, in accordance with a second exemplary embodiment of the present disclosure. FIG. 5C is a cross-sectional view illustration of the expansion/control joint 102 of FIG. 5B in use within a stucco or plaster wall, in accordance with the second exemplary embodiment of the present disclosure.

As is shown in FIGS. 5A-5C, in the second exemplary embodiment, the expansion/control joint 102 may have only a single flexible panel 153, as opposed to the two panels 51, 53 shown in FIGS. 2-4. The expansion/control joint includes a first base panel 113 having a front face 115 over which plaster or stucco material 4, 5 is applied after the expansion/control joint 102 is mounted in place on the backing wall 11 or surface thereof, such as over a layer 3 of galvanized wire which is anchored over felt paper 1, as shown in FIG. 5C. Stucco stop walls 117, 135 are formed on the first base panel 113 and the second base panel 131, respectively, and extend outwardly above the front face 115 of the first base panel 113 and the front face 133 of the second base panel 131. Similar to the structures of FIGS. 2-4, the stucco stop walls 117, 135 may each have a flange or return 123, 141 formed on the upper end portion 125 of each, to assist in containing plaster or stucco, with the flanges 123, 141 having the portions which extend laterally away from the stucco stop walls 117, 135 and over the first and second base panels 113, 131, respectively. The flanges 123, 141 may further have turned back portions which extend from the distal ends thereof in a direction towards the front faces 115, 133 of the base panels 113, 131, respectively. The flanges 123, 141 and the turned back portions may aid in retaining the finish stucco or plaster layer 5 against the expansion/control joint 102, such that the joint formed between the finish stucco or plaster layer 5 and the stucco stop walls 117, 135 remain in an abutting position. In particular, the turned back portions may act as a structural stop which is imbedded in the stucco layer 5 to prevent dislodgement thereof.

The use of only a single panel 153, as opposed to two panels per the first exemplary embodiment, may reduce the manufacturing costs of the expansion/control joint 102 by providing easier extruding of the structure or easier manufacturing by other means. Further, the single panel 153 may still be capable of connecting the first and second stucco stop walls 117, 135 while allowing them to flex, as needed. Instead of forming a hollow tube extending along and between the stucco stop walls 117 and 135, the use of the single panel 153 may allow for an open channel to be created above the single panel 153 and a closed channel below the single panel 153, where the closed channel abuts a wall surface and where the open channel can receive a bond breaking tape 55 and caulk 6 when the product is installed, as shown in FIG. 5C. The single panel 153 may facilitate the two stucco stop walls 117 and 135 to move closer to each other in response to expansion forces placed on the expansion/control joint 102 by the stucco or plaster walls or surfaces in contact with the expansion/control joint 102, and such that force placed thereon due to contraction of the stucco or plaster wall or surface tends to straighten the panel 153 to permit the two stucco stop walls 117 and 135 to move away from each other in response to contraction forces placed on the expansion/control joint 102 by the stucco or plaster walls or surfaces in contact with the expansion/control joint 102.

It is noted that the single panel 153 may be constructed from the same material as the stucco stop walls 117, 135 and the base panels 113, 131 or it may be constructed from a different material, or a similar material with different structural properties. For example, it may be advantageous to form the single panel 153 from a vinyl material which is more flexible than a vinyl material used to form the stucco stop walls 117, 135 and the base panels 113, 131. In this example, the additional flexibility of the single panel 153 may be achieved through a different vinyl composition for the single panel 153, a smaller thickness of the single panel 153, or another manufacturing or structural difference. As shown in FIGS. 5B and 5C, the single panel 153 may have a thickness of substantially half the thickness of the stucco stop walls 117, 135 and the base panels 113, 131. Additionally, the single panel 153 may include interfacing portions on either lateral edge thereof, which interface with the interior-facing side of the stucco stop walls 117, 135, which may allow the single panel 153 to flex and move as needed within the stucco wall without breaking or becoming separated from the stucco stop walls 117, 135. When the single panel 153 is formed from a different material from the stucco stop walls 117, 135 and the base panels 113, 131, the material of the single panel 153 should be compatible with the material of the stucco stop walls 117, 135 and the base panels 113, 131 to ensure co-extrusion or co-manufacturing thereof.

Figure 5D:
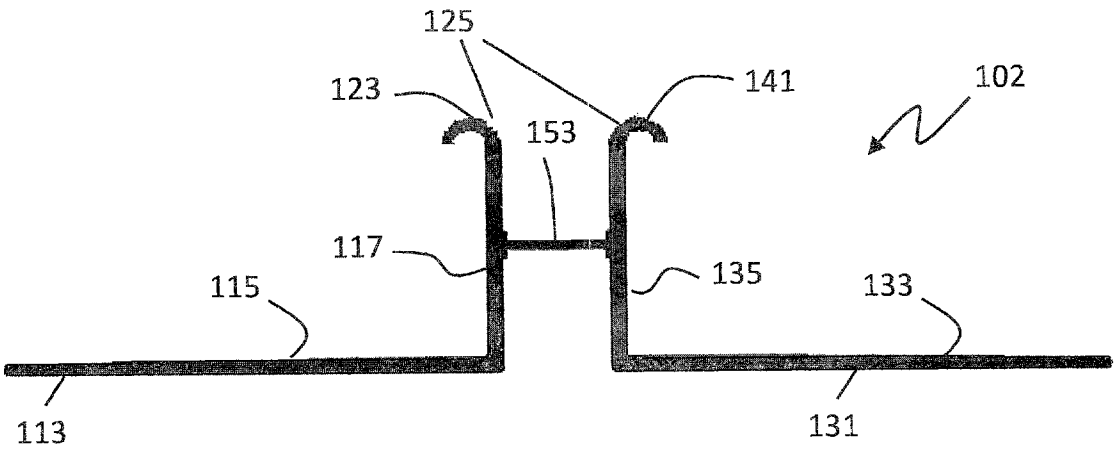
FIG. 5D is a side view illustration of an expansion/control joint, in accordance with the second exemplary embodiment of the present disclosure.
Figure 5E:
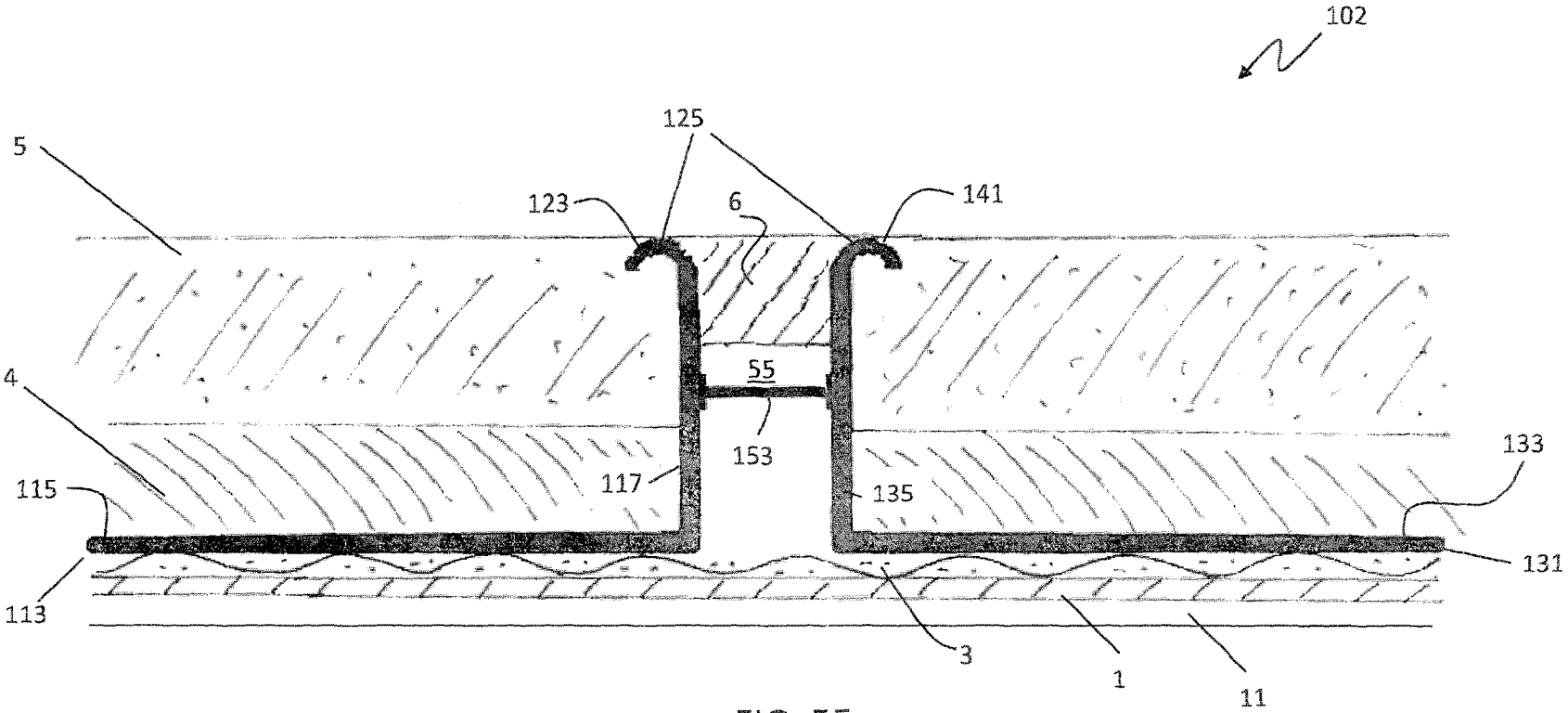
FIG. 5E is a cross-sectional view illustration of the expansion/control joint of FIG. 5D in use within a stucco or plaster wall, in accordance with the second exemplary embodiment of the present disclosure.

FIG. 5D is a side view illustration of an expansion/control joint 102, in accordance with the second exemplary embodiment of the present disclosure. FIG. 5E is a cross-sectional view illustration of the expansion/control joint 102 of FIG. 5D in use within a stucco or plaster wall, in accordance with the second exemplary embodiment of the present disclosure. FIGS. 5D-5E depict a similar design to that of FIGS. 5A-5C, and include any of the features, structures, or functions disclosed relative to FIGS. 5A-5C. However, the expansion/control joint 102 of FIGS. 5D-5E further include the flange or return 123, 141 formed on the upper end portion 125 of each of the stucco stop walls 117, 135, to assist in containing plaster or stucco, with the flanges 123, 141 having the portions which extend laterally away from the stucco stop walls 117, 135 and over the first and second base panels 113, 131, respectively. The flanges 123, 141 have turned back portions which extend from the distal ends thereof in a direction towards the front faces 115, 133 of the base panels 113, 131, respectively. The flanges 123, 141 and the turned back portions are curved or shaped along a continuous arced path, which allows for the flanges 123, 141 to aid in retaining the finish stucco or plaster layer 5 against the expansion/control joint 102, such that the joint formed between the finish stucco or plaster layer 5 and the stucco stop walls 117, 135 remain in an abutting position. In particular, the turned back portions may act as a structural stop which is imbedded in the stucco layer 5 to prevent dislodgement thereof.

Additionally, the continuous arced path or circular curvature of the flanges 123, 141 minimizes the portions of the flanges 123, 141 that will be visible along the exterior of the finished stucco wall. For example, only the very distal points of the flanges 123, 141, e.g., along the distal edges of the curve, may be visible when the finished stucco coat is applied, which acts to reduce the unsightly nature of the expansion/control joint 102 and allows installers to use color-neutral expansion/control joints 102 instead of needing to match a finished color of the wall. The flanges 123, 141 may include different shapes, curvatures, and dimensions, including curved flanges 123, 141 with differing radii.

Figure 6A:
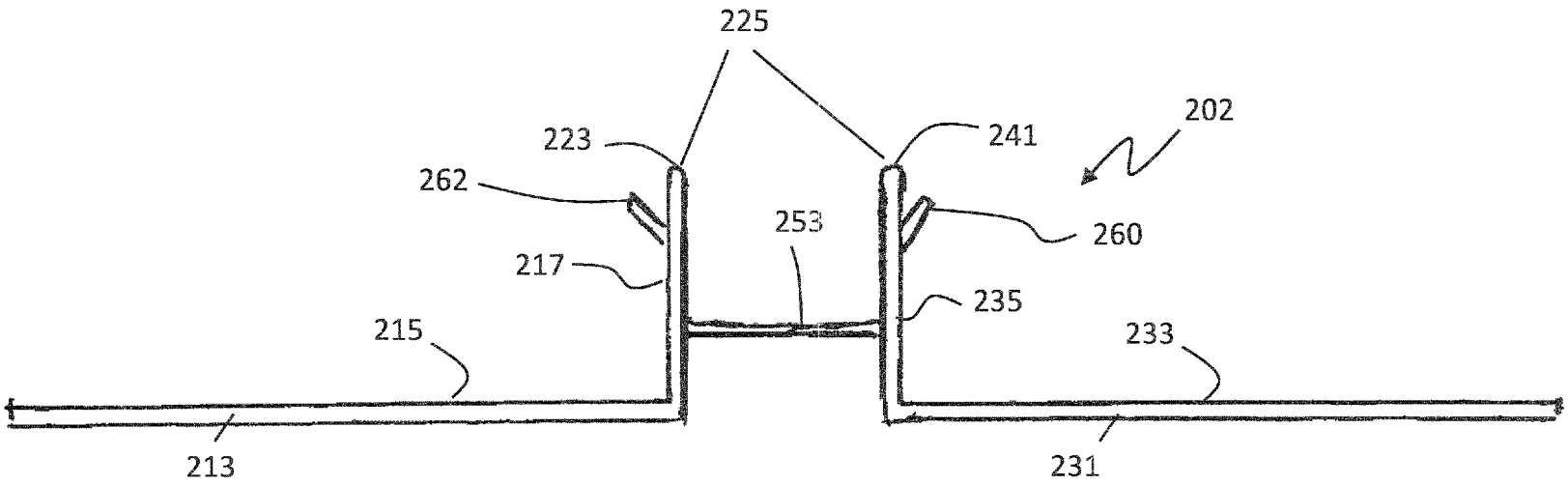
FIG. 6A is a side view illustration of an expansion/control joint, in accordance with a third exemplary embodiment of the present disclosure.
Figure 6B:
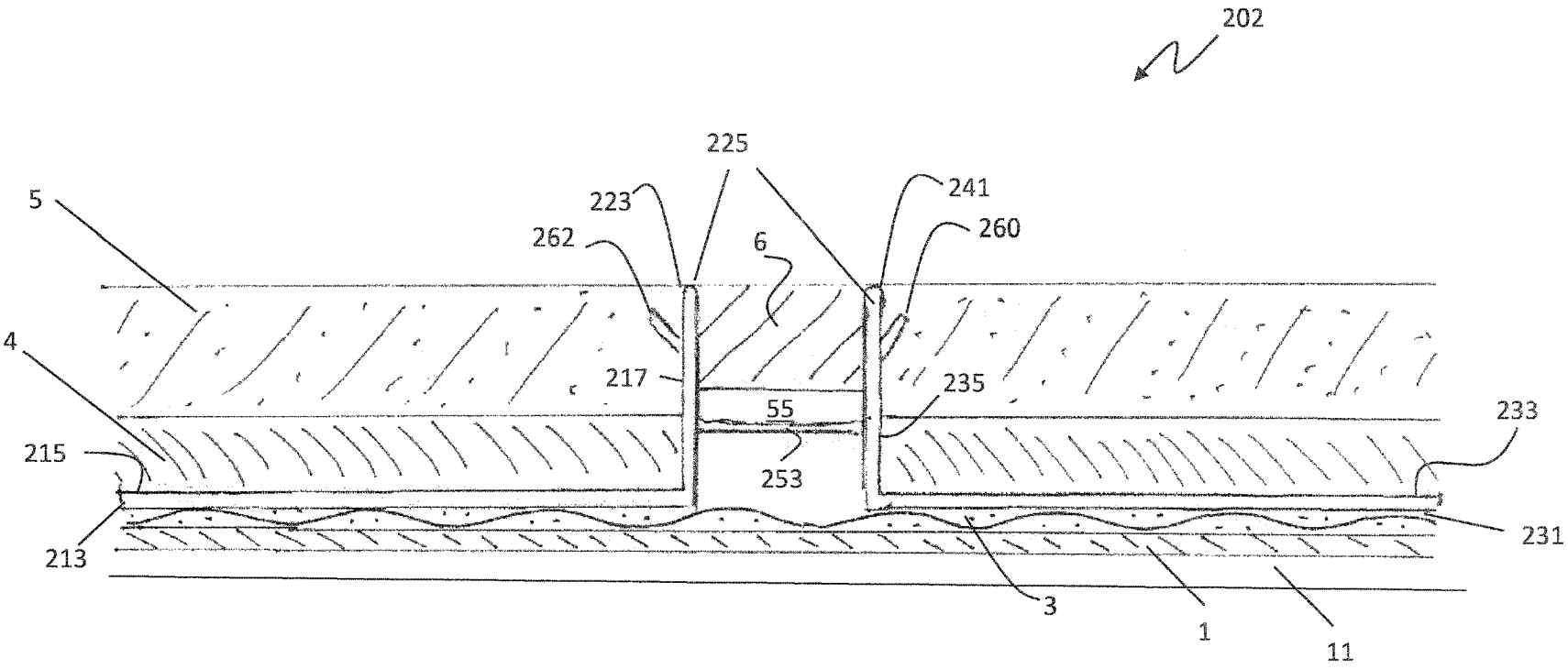
FIG. 6B is a side view illustration of the expansion/control joint of FIG. 6A in use with a stucco or plaster wall, in accordance with the third exemplary embodiment of the present disclosure.

FIG. 6A is side view illustration of an expansion/control joint 202, in accordance with a third exemplary embodiment of the present disclosure. FIG. 6B is side view illustration of the expansion/control joint 202 of FIG. 6A in use with a stucco or plaster wall, in accordance with the third exemplary embodiment of the present disclosure. As is shown in this embodiment, the expansion/control joint 202 may be similar to the embodiment of FIGS. 5A-5C, in that it has only a single panel 253, as opposed to the two panels 51, 53 shown in FIGS. 2-4, but the third exemplary embodiment may be different in that it has stucco stop walls 217, 235 which terminate at rounded edges 225. To allow the stucco to be retained to the expansion/control joint 202 during installation and there afterwards, the expansion/control join 202 may include angular flanges 260, 262, which extend from the exterior-facing sides of the stucco stop walls 217, 235. The angular flanges 260, 262 are formed on the stucco stop walls 217, 235 in a position below the terminating edges 225 of the stucco stop walls 217, 235. These angular flanges 260, 262 may extend angularly outwards from the single panel 153 at a diagonal angle.

The use of the rounded edges 225 and the angular flanges 260, 262 may allow for a better finish of the stucco or plaster wall, while providing sufficient structural integrity for the stucco or plaster joint and the interface between the stucco or plaster material 4, 5 (FIG. 6B) and the expansion/control joint 202. In use, the expansion/control joint 202 can be installed against a layer 3 of galvanized wire anchored over felt paper 1 to a backing wall 11. The stucco material 4,5 can be forced against the stucco stop walls 217, 235 and in front of the angular flanges 260, 262 and behind them during installation. Once the stucco or plaster is cured, the hardened material is fully bonded to the angular flanges 260, 262, which act as imbedded structural members to prevent separation between the stucco material 4, 5 and the stucco stop walls 217, 235. The resulting finish of the expansion/control joint 202 may be more aesthetic than the second exemplary embodiment and other previous designs, since the terminating edges 225 may be only barely visible at their very distal edges, which allows the expansion/control joint 202 to be significantly less visible on the wall than the previously used flange portions (FIGS. 2-5C) which have a flat front which faces outward on the wall. The design of the third exemplary embodiment also allows for less of a need of color matching the expansion/control joint 202 to the color of the wall and/or the color of caulking positioned within the slot formed between the two stucco walls 217, 235, since the visibility of the expansion/control joint 202 is significantly decreased. In use, as shown in FIG. 6B, a bond breaking tape 55 can be applied to the single panel 253, with a layer of caulk 6 positioned over it, as previously described.

Similar to FIGS. 5A-5B, the use of only a single flexible panel 253 as opposed to two panels may reduce the manufacturing costs of the article by providing easier extruding of the structure or easier manufacturing by other means. Further, the single panel 253 may still be capable of connecting the first and second stucco stop walls 217, 235 while allowing them to flex, as needed. Instead of forming a hollow tube extending along and between the stucco stop walls 217 and 235, the use of the single panel 253 may allow for an open channel to be created above the single panel 253 and a closed channel below the single panel 253, where the closed channel abuts a wall surface and where the open channel can receive caulk 6 when the product is installed. The single panel 253 may facilitate the two stucco stop walls 217 and 235 to move closer to each other in response to expansion forces placed on the expansion/control joint 202 by the stucco or plaster walls or surfaces in contact with the expansion/control joint 202, and such that force placed thereon due to contraction of the stucco or plaster wall or surface tends to straighten the panel 253 to permit the two stucco stop walls 217 and 235 to move away from each other in response to contraction forces placed on the expansion/control joint 202 by the stucco or plaster walls or surfaces in contact with the expansion/control joint 202. The material and/or construction of the expansion/control joint 202 of the third exemplary embodiment may be similar to that of the second exemplary embodiment with regards to the use of different materials or different structural dimensions.

It should be emphasized that the above-described embodiments of the present disclosure, particularly, any "preferred" embodiments, are merely possible examples of implementations, merely set forth for a clear understanding of the principles of the disclosure. Many variations and modifications may be made to the above-described embodiment(s) of the disclosure without departing substantially from the spirit and principles of the disclosure. All such modifications and variations are intended to be included herein within the scope of this disclosure and the present disclosure and protected by the following claims.

What is claimed is:

1. An expansion/control joint for use within at least one of a stucco and plaster wall, the expansion/control joint comprising:

a first base panel having a first stucco stop wall formed on the first base panel and extending from the first base panel;

a second base panel having a second stucco stop wall formed on the second base panel and extending from the second base panel, wherein the second stucco stop wall is spaced a distance from the first stucco stop wall, a flange positioned at an upper-most end portion of each of the first and second stucco stop walls, each flange having a lateral portion and a return portion, wherein the lateral portion of each flange extends laterally sideways from the first and second stucco stop walls, respectively, and the return portion extends towards each of the first and second base panels, respectively, wherein the lateral portion of each flange is positioned between the return portion and the first and second stucco stop walls, respectively, and wherein the lateral portion of each flange forms an exterior-most portion of the expansion/control joint;

a single expansion joint connected between the first and second stucco stop walls and extending the spaced distance between the first and second stucco stop walls; and a bond-breaking structure positioned within the spaced distance exterior of the single expansion joint, wherein the bond breaking structure covers an entirety of an exterior-most surface of the single expansion joint.

2. The expansion/control joint of claim 1, wherein the single expansion joint is positioned in a forward offset position from the first and second base panels.

3. The expansion/control joint of claim 1, wherein the single expansion joint has a thickness less than a thickness of at least one of: the first and second stucco stop walls; and the first and second base panels.

4. An expansion/control joint within a stucco or plaster wall comprising:

a first base panel having a first stucco stop wall formed on the first base panel and extending from the first base panel;

a second base panel having a second stucco stop wall formed on the second base panel and extending from the second base panel, wherein the second stucco stop wall is spaced a distance from the first stucco stop wall, each of the first and second stucco stop walls having a flange positioned at an upper end portion thereof, each flange having a lateral portion and a return portion, wherein the lateral portion of each flange extends laterally sideways from the first and second stucco stop walls, respectively, and the return portion extends towards each of the first and second base panels, respectively, wherein the lateral portion of each flange is positioned between the return portion and the first and second stucco stop walls, respectively, wherein the first and second base panels are affixed to a backing within the wall, wherein the first and second stucco stop walls extend outwardly from the wall, and wherein at least one layer of at least one of stucco and plaster is positioned over the first and second base panels and an exterior-most layer of the at least one of stucco and plaster is positioned aligned with the lateral portion of each flange; and a single expansion joint connected between the first and second stucco stop walls and extending the spaced distance between the first and second stucco stop walls, wherein a bond breaking tape and quantity of caulk is positioned within the spaced distance exterior of the single expansion joint, wherein the bond breaking tape covers an entirety of the exterior-most surface of the single expansion joint, wherein an exterior surface of the quantity of caulk is positioned in substantial alignment with an exterior surface of the at least one layer of at least one of stucco and plaster positioned over the first and second base panels.

5. The expansion/control joint within the stucco or plaster wall of claim 4, wherein the single expansion joint is positioned in a forward offset position from the first and second base panels.

6. The expansion/control joint within the stucco or plaster wall of claim 4, wherein the single expansion joint has a thickness less than a thickness of at least one of: the first and second stucco stop walls; and the first and second base panels.

7. The expansion/control joint of claim 1, wherein the lateral portion and the return portion of the flange are formed together with a substantially perpendicular junction.

8. The expansion/control joint of claim 1, wherein the lateral portion and the return portion of the flange are formed together along a continuous curvilinear path.

9. The expansion/control joint of claim 1, wherein an exterior-facing surface of the first and second stucco stop walls is free from protruding structures in a space between the flange and the first and second base panels, respectively.

10. The expansion/control joint of claim 1, wherein the return portions of the flange are positioned entirely in a forward offset position relative to di the single expansion joint, whereby a lateral plane of the single expansion joint is not intersecting with the return portions of the flange.

11. The expansion/control joint of claim 1, wherein the single expansion joint, extending the spaced distance between the first and second stucco stop walls, has a planar shape which is free from curvatures.

12. The expansion/control joint within the stucco or plaster wall of claim 4, wherein the lateral portion and the return portion of the flange are formed together with a substantially perpendicular junction.

13. The expansion/control joint within the stucco or plaster wall of claim 4, wherein the lateral portion and the return portion of the flange are formed together along a continuous curvilinear path.

14. The expansion/control joint within the stucco or plaster wall of claim 4, wherein the lateral portion of each flange forms an exterior-most portion of the expansion/control joint within the stucco or plaster wall.

15. The expansion/control joint within the stucco or plaster wall of claim 4, wherein an exterior-facing surface of the first and second stucco stop walls is free from protruding structures in a space between the flange and the first and second base panels, respectively.

16. The expansion/control joint within the stucco or plaster wall of claim 4, wherein an exterior surface of the quantity of caulk is positioned aligned with the lateral portion of each flange.

17. The expansion/control joint within the stucco or plaster wall of claim 4, wherein the return portions of the flange are positioned entirely in a forward offset position relative to the single expansion joint, whereby a lateral plane of the single expansion joint is not intersecting with the return portions of the flange.

18. An expansion/control joint within a stucco or plaster wall comprising:

a first base panel having a first stucco stop wall formed on the first base panel and extending from the first base panel;

a second base panel having a second stucco stop wall formed on the second base panel and extending from the second base panel, wherein the second stucco stop wall is spaced a distance from the first stucco stop wall, each of the first and second stucco stop walls having a flange positioned at an upper end portion thereof, each flange having a lateral portion and a return portion, wherein the lateral portion of each flange extends laterally sideways from the first and second stucco stop walls, respectively, and the return portion extends towards each of the first and second base panels, respectively, wherein the lateral portion of each flange is positioned between the return portion and the first and second stucco stop walls, respectively, wherein the first and second base panels are affixed to a backing within the wall, wherein the first and second stucco stop walls extend outwardly from the wall, and wherein at least one layer of at least one of stucco and plaster is positioned over the first and second base panels and an exterior-most layer of the at least one of stucco and plaster is positioned aligned with the lateral portion of each flange; and a single expansion joint connected between the first and second stucco stop walls and extending the spaced distance between the first and second stucco stop walls, wherein a bond breaking strip and quantity of caulk is positioned within the spaced distance exterior of the single expansion joint, wherein the bond breaking strip covers an entirety of the exterior-most surface of the single expansion joint, wherein an exterior surface of the quantity of caulk is positioned in substantial alignment with an exterior surface of the at least one layer of at least one of stucco and plaster positioned over the first and second base panels.

* * * * *